US006763890B2

(12) United States Patent
Polsky et al.

(10) Patent No.: US 6,763,890 B2
(45) Date of Patent: Jul. 20, 2004

(54) MODULAR COILED TUBING SYSTEM FOR DRILLING AND PRODUCTION PLATFORMS

(75) Inventors: Yarom Polsky, Pearland, TX (US); Rod Shampine, Houston, TX (US); Terry McCafferty, Brookshire, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 70 days.

(21) Appl. No.: 10/191,645

(22) Filed: Jul. 9, 2002

(65) Prior Publication Data

US 2003/0221835 A1 Dec. 4, 2003

Related U.S. Application Data

(60) Provisional application No. 60/386,166, filed on Jun. 4, 2002.

(51) Int. Cl.[7] ..... E21B 29/12

(52) U.S. Cl. ..... 166/360; 166/365; 166/77.2; 166/77.3

(58) Field of Search ..... 166/351, 360, 166/365, 339, 77.2, 77.3

(56) References Cited

U.S. PATENT DOCUMENTS 3,777,812 A * 12/1973 Burkhardt et al. ..... 166/338
3,913,669 A * 10/1975 Brun et al. ..... 166/349
4,108,318 A * 8/1978 Rode et al. ..... 414/22.51
4,265,304 A * 5/1981 Baugh ..... 166/77.2
4,519,727 A * 5/1985 Mitchell et al. ..... 405/204
5,244,046 A * 9/1993 Council et al. ..... 166/380
5,310,286 A * 5/1994 Gilbert et al. ..... 405/169
5,660,235 A * 8/1997 Sola ..... 166/384
5,671,811 A * 9/1997 Head ..... 166/346
5,937,943 A * 8/1999 Butler ..... 166/77.2
5,960,885 A * 10/1999 Edwards et al. ..... 166/345
6,173,769 B1 * 1/2001 Goode ..... 166/77.3
6,276,454 B1 * 8/2001 Fontana et al. ..... 166/343
6,422,315 B1 * 7/2002 Dean ..... 166/339
6,457,526 B1 * 10/2002 Dailey ..... 166/338
6,488,093 B2 * 12/2002 Moss ..... 166/339
6,494,268 B1 * 12/2002 Ljungdahl et al. ..... 166/379
6,494,397 B1 * 12/2002 Myklebust ..... 242/399.1
6,502,641 B1 * 1/2003 Carriere et al. ..... 166/384
6,609,565 B1 * 8/2003 Andreychuk et al. ..... 166/77.2

* cited by examiner

*Primary Examiner*—Robert L. Pezzuto
*Assistant Examiner*—Thomas A Beach
(74) *Attorney, Agent, or Firm*—Stephen Schlather; Robin Nava

(57) ABSTRACT

A modular work system permits Rig Up time to be substantially reduced by reducing the number of crane lifts required to offload equipment for a transport boat or vehicle. This is achieved by developing transport skids capable of holding multiple system components. The number of equipment components that must be mechanically coupled on location is reduced by pre-assembling the components and maintaining the assembly in operating condition during storage and transport. Skid design concepts are employed, wherein a skid system carries various pre-assembled components for transport, storage and operation. Specifically, a skid sub-system includes various related components. The components are either pre-assembled or are designed to complete a sub-assembly through final assembly on the rig. The skid is moved into place using the crane, and the assembly is completed. Additional sub-systems are mounted on additional skids which are designed to be mated with the other related skids and sub-assemblies. Each skid sub-system fits in an envelope meeting transportation regulations for vehicle width and height. The system is particularly suitable for jacking frame operations.

20 Claims, 21 Drawing Sheets

MODULAR COILED TUBING SYSTEM FOR DRILLING AND PRODUCTION PLATFORMS

This application claims benefit to the provisional application 60/386,166, filed Jun. 4, 2002.

BACKGROUND OF THE INVENTION

1. Field of the Invention

The subject invention is generally related to modular systems for work functions on a drilling or production rig or platform and is specifically directed to the composition, operation, and performance of a skid based modular system for coiled tubing and similar operations.

2. Discussion of the Prior Art

Various operations are routinely performed on drilling and production platforms. Each of the operations includes subsets of equipment and specific operational functions associated with the equipment. By way of example, a coiled tubing operation includes a plurality of different processes or sequences of actions, some of which can be viewed as general to the service and some of which can be viewed as specific to the particular system used. The general process components include positioning equipment on the platform, assembling the equipment, stabbing tubing, pressure testing well control equipment and similar functions incorporated regardless of the specific equipment used. Specific functions are dictated by the particular equipment and system being utilized.

The deployment of coiled tubing pressure control and conveyance equipment in offshore environments is a time consuming process made complicated by spatial constraints, crane lifting limitations, safety considerations and intensive assembly on location. The majority of coiled tubing systems utilized offshore to date incorporate virtually no pre-assembly of system components making the Rig Up process extremely inefficient. This is particularly true for systems utilizing the multiple pressure control components required to perform high pressure work.

A constant in all systems is the requirement that the various components of the system be moved into place, assembled and tested prior to initiation of the operation. In the industry, this is generally referred to as "Rig Up" work. The amount of time and expense involved in Rig Up work is substantial and dramatic increases in profitability of the rig can be achieved with small time savings in repetitive Rig Up operations.

Very little integration of conveyance and pressure control equipment is currently utilized offshore. Coiled tubing jacking frames are currently used in offshore environments to support and manipulate coiled tubing conveyance equipment. The typical CT jacking frame consists of a four-post support system containing a one or two-dimensional in-plane translation type table into which the injector is inserted. The injector support can also be raised or lowered. One type of system also possesses a rotation table for aligning the injector gooseneck with the reel. Due to spatial transport restriction, the injector and jacking frame are transported separately onto the platform. Pressure control equipment including BOPs, riser sections and strippers are separately lifted into appropriate positions in the well stack. In the prior art systems, a minimum of seven components must be separately installed on location.

The principal hindrance in the Rig Up of existing coiled tubing systems is the need to assemble virtually every component in the system on location. This fragmentation of the operation results in numerous crane lifts to move equipment components into position and numerous assembly steps to couple these components together.

A major drawback to pre-rigging or assembly prior to Rig Up is the sheer size of the equipment being utilized. In order to achieve maximum benefit by pre-assembly the equipment must fit reasonable transportation dimensions.

To date, there are not any available systems that permit comprehensive pre-rigging at an offsite location. It is desirable that such a system be developed for increasing safety by eliminating repeated make-up and break-down of critical assemblies, and by permitting increased efficiency in installing such systems for operation. It is also desirable that such a system be developed to permit transport to and from a rig in standard transport systems and containers in its assembled state.

SUMMARY OF THE INVENTION

The subject invention is directed to a modular, pre-assembled system for rig workovers, and the preferred embodiment is a modular, pre-assembled system specifically designed for coiled tubing operations. The system of the subject invention results in improved equipment utilization and in significant improvements in time, personnel and safety issues. The system also improves safety and environmental concerns by minimizing Rig Up time through the ability to pre-assemble many critical safety components off rig and in controlled factory environment.

One important aspect of the invention is that the use of pre-assembled modular components frees up the rig crane, always a bottleneck in offshore work. By permitting a plurality of pre-assembled components to be transported into and out of operational position, the time required by the rig crane is substantially reduced.

Specifically, the subject invention is directed to a modular work system permitting Rig Up time to be substantially reduced by reducing the number of crane lifts required to offload equipment from a transport boat or other transport vehicle. This is achieved by developing transport skids capable of holding multiple system components. The invention is also directed to reducing the number of crane lifts required to position equipment on the platform. One objective of the present invention to reduce the number of equipment components that must be mechanically coupled on location by pre-assembling the components and maintaining the assembly in operating condition during storage and transport. This pre-assembly also applies to hydraulic and other control lines. An additional advantage of the system of the subject invention is the reduction of personnel time and numbers required to support the operation on the rig.

In order to achieve the objectives of the invention, skid design concepts are employed, wherein a skid system carries various pre-assembled components for transport, storage and operation. Specifically, a skid sub-system includes various related components. The components are either pre-assembled or are designed to complete a sub-assembly through final assembly on the rig. The skid is moved into place using the crane, and the assembly is completed. Additional sub-systems are mounted on additional skids which are designed to be mated with other related skids and sub-assemblies.

It is an important aspect of the invention that each skid sub-system fit within specific size or space constraints in order to meet transportation regulations for vehicle width and height. By way of example, standard offshore containers have widths of 2.5 m and height of 2.8 m. Skid height may also be a function of the trailer deck height. For example, Norwegian transport laws stipulate that a truck cannot be more than 4.0 m in height. Obviously, a "low-boy" trailer with a deck height of 0.5 m will permit a taller or higher skid height than a standard trailer with a deck height of 1.0 m. Skid length is also dictated by useful trailer length, which is typically, about 6.0 m. Weight is also a factor, both for transportation and crane lifting functions. Each skid is preferably designed to incorporate the maximum amount of equipment required for a particular job, while remaining within the various size and weight limits imposed on the transport of such equipment.

A preferred embodiment of the invention is directed to a coiled tubing operating system and comprises nine pre-assembled skid components, namely, the control cabin, power pack, reel, power stand, jacking frame, blowout preventer (BOP) transport frame, BOP accumulator/control skid, shaker tank and workshop container. Efficient rig-up is accomplished by having the riser and triple BOP components travel assembled and by having the tubing injector travel assembled to the jacking frame and stripper, preferably with the gooseneck attached. The system is designed to be set up with a minimum of connections between skid units, thereby greatly increasing efficiency, as well as making the various Rig-Up operations safter through the use of factory assembled and tested connections and components.

In the past, assembly of the well control stack and injector was identified as being one of the most time consuming parts of the Rig Up process. The subject invention for the jacking frame travels with the injector and stripper assembled and the gooseneck attached, but folded to meet envelope requirements, with an objective of significantly reducing setup time associated with these components. The BOP transport skid is designed to mechanically interface with the jacking frame and skid, eliminating the need to rely on the orientation of the frame to the deck to assure coupling accuracy. That is, the BOP skid forms a support base for the jacking frame. Both components are designed to permit proper mating and interconnectivity. This assures efficient and accurate connections.

In the preferred embodiment of the invention, the injector is supported on a platform with a skid-plate that allows rotation about the vertical axis. The injector platform is attached to single columnar support adapted for vertical translation. The base of the support travels on a rail system to permit horizontal motion and placement.

In those cases where the overall height exceeds transportation requirements, each assembly is designed to travel on it's side and may be pivoted into operating position during Rig Up.

In a preferred embodiment of the invention, the jacking system provides four axis motion of the injector. The system can raise and lower the injector to provide a work window between the stripper and BOP. The jacking frame is designed to allow transfer of all operation induced vertical load to the wellhead. The jacking system will provide the required motion while supporting the injector, stripper and gooseneck. The jacking system includes work decks and handrails for access to the service areas of the injector. The system is designed for quick and simple deployment. Ladders may be included in the integral system.

The jacking system or jacking fram of the present invention incorporates or includes a number of features which allow safer, more efficient Rig-Up operations. The jacking frame, by using a single, movable columnar support, allows greater access to the BOP and the well. In addition, the jacking frame allows the injector, goosemech and related equipment to be quickly and easily moved, thereby allowing access, for instance, crane access, to the well. The jacking frame may carry some or all of the BOP stack, as may be required for a particular operation. This is particularly useful where certain hangoffs are desired. In addition, the jacking frame may be used to carry the BOP stack off the wellhead.

In the preferred embodiment, the BOP transport skid houses a triple BOP stack, a shear seal or safety head as required, and an additional pipe/slip ram. The transport skid is designed to minimize the required steps for assembling the well control stack. In those cases where a safety-head shear seal ram is required, the ram is designed to be tilted in order to fit through the rig floor opening. In this configuration, the safety head will travel coupled to the pipe/slip ram. In one embodiment, the ram assembly may travel with the rams oriented in the vertical position, will be lifted, dropped through the deck, rotated and fastened to the wellhead. The triple BOP, riser and BOP work platform will travel assembled in the horizontal position and will be pivoted into place on the rig. The working platform is also integral and is folded into the skid envelope.

Crash frames may be provided during transportation and storage.

Various other skids are supplied as required for the operation, as described above.

DETAILED DESCRIPTION OF THE PREFERRED EMBODIMENT

Figure 1:
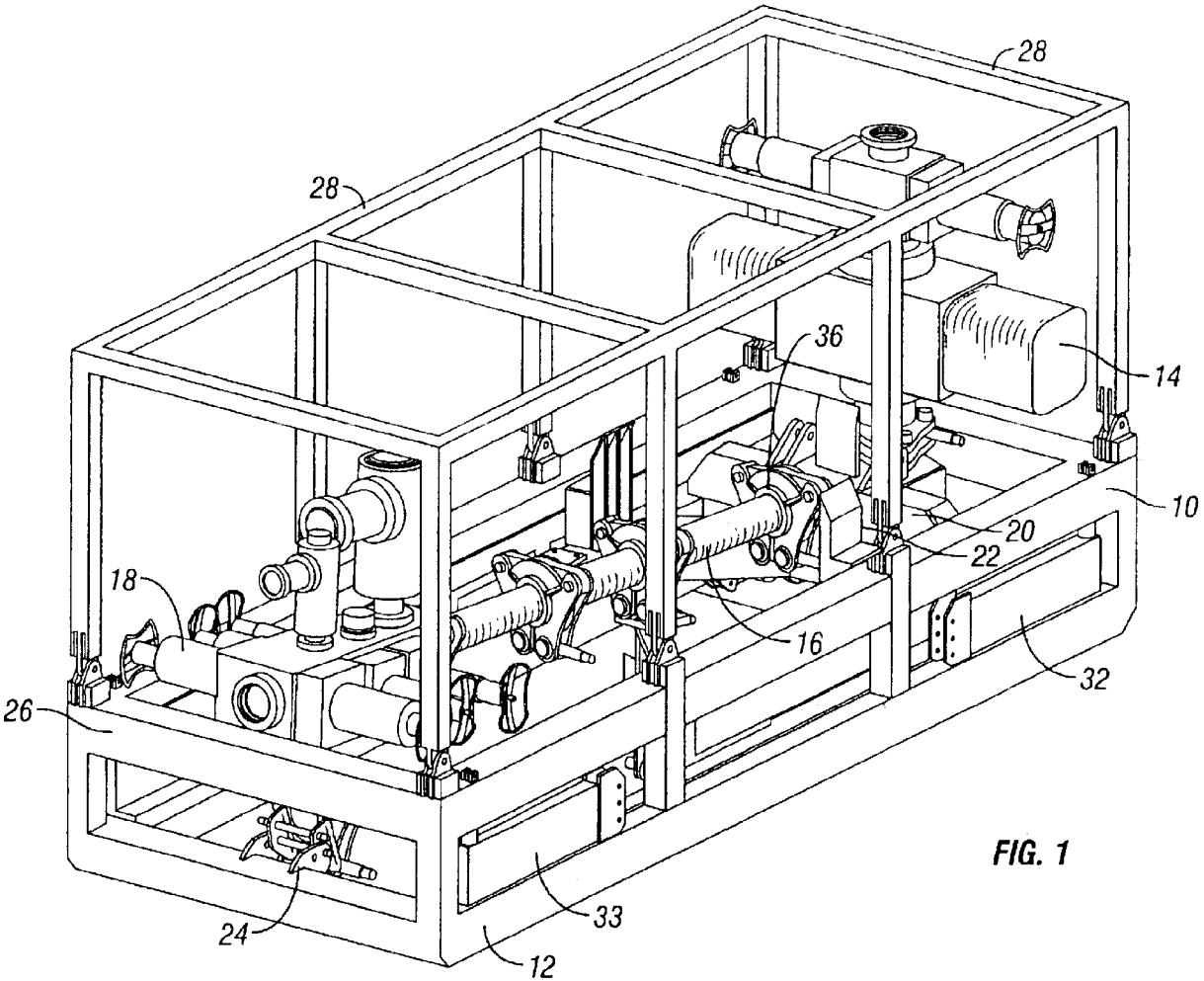
FIG. 1 is a perspective view of the BOP transport skid in accordance with the teaching of the subject invention.
Figure 2:
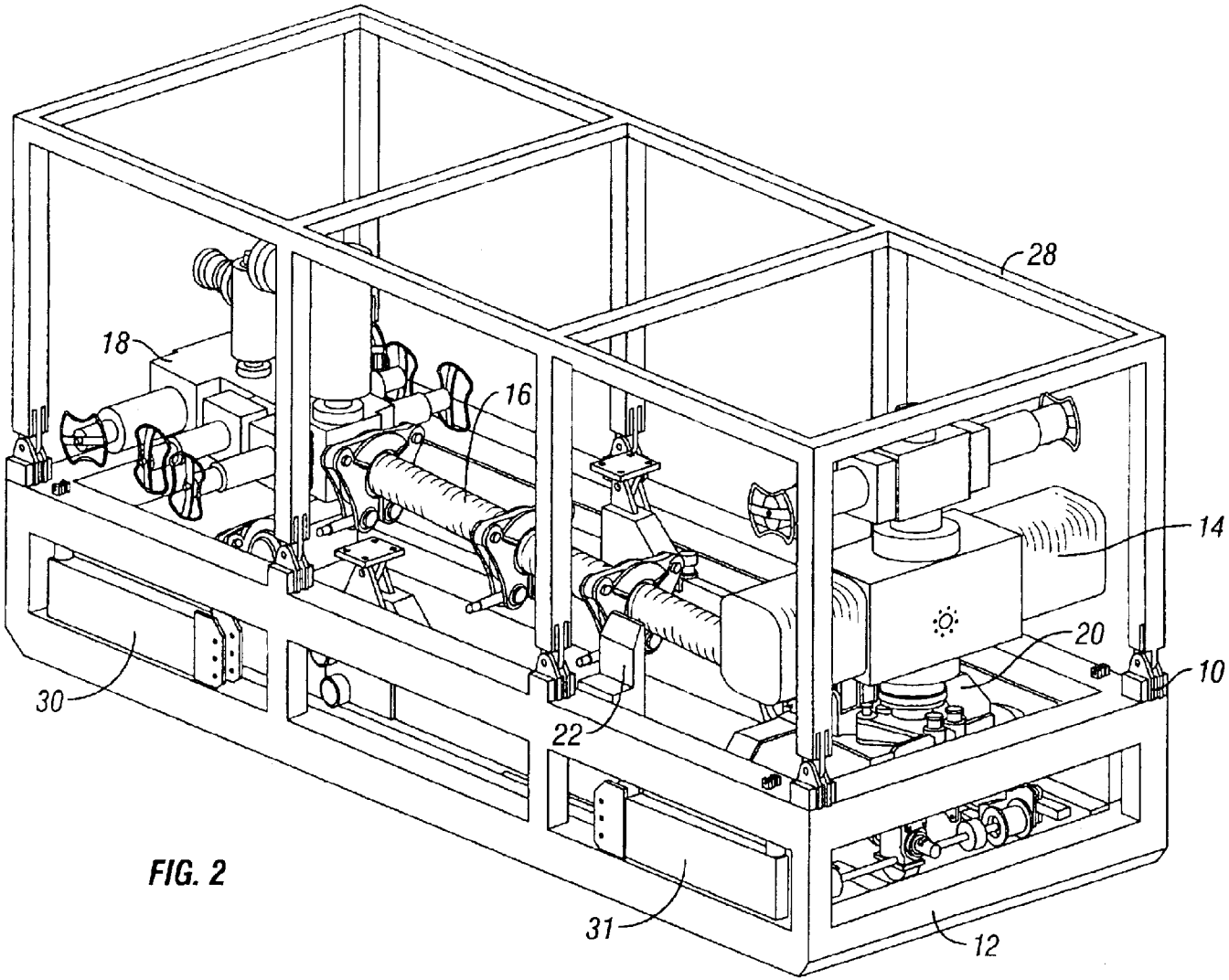
FIG. 2 is a reverse perspective view of the BOP transport skid of FIG. 1.

A typical BOP transport skid 10 is shown in FIGS. 1 and 2. The skid is a sturdy framework having a lower base 12 for supporting nesting safety head components 14, a riser 16 and a triple BOP stack 18. This configuration permits the components of the assembly to fit in an envelope suitable for standard transportation methods. Various support brackets 20, 22 and 24 secure the safety head, riser and BOP stack on the skid. This permits pre-assembly of the safety head and pre-assembly of the riser/BOP at an off rig location. The upper rail 26 of the skid is adapted for supporting a transport crash frame 28 for protecting the various nested components while in transit and while stored. Four legs 30, 31, 32 and 33 are pivotally mounted on the skid, and as will be explained, provide leveling and stabilizing support for the skid when it is in its operating position. In a typical application, the lower end 36 of the riser is pivotally mounted in bracket 22 so that it may be pivoted to a vertical position prior to disconnecting it from the skid 10. The assembled skid 10 can be transported and stored as a unit. Once positioned at an operating location on the rig, the crash frame 28 is removed, and the safety head 14 is lifted from the skid and dropped into position below deck. The skid 10 is then positioned over the safety head 14 and the riser 16 and BOP 18 are pivoted as a unit, lifted and dropped into position on the safety head. The skid 10 is then stabilized in position to provide a support structure for other components.

Figure 3:
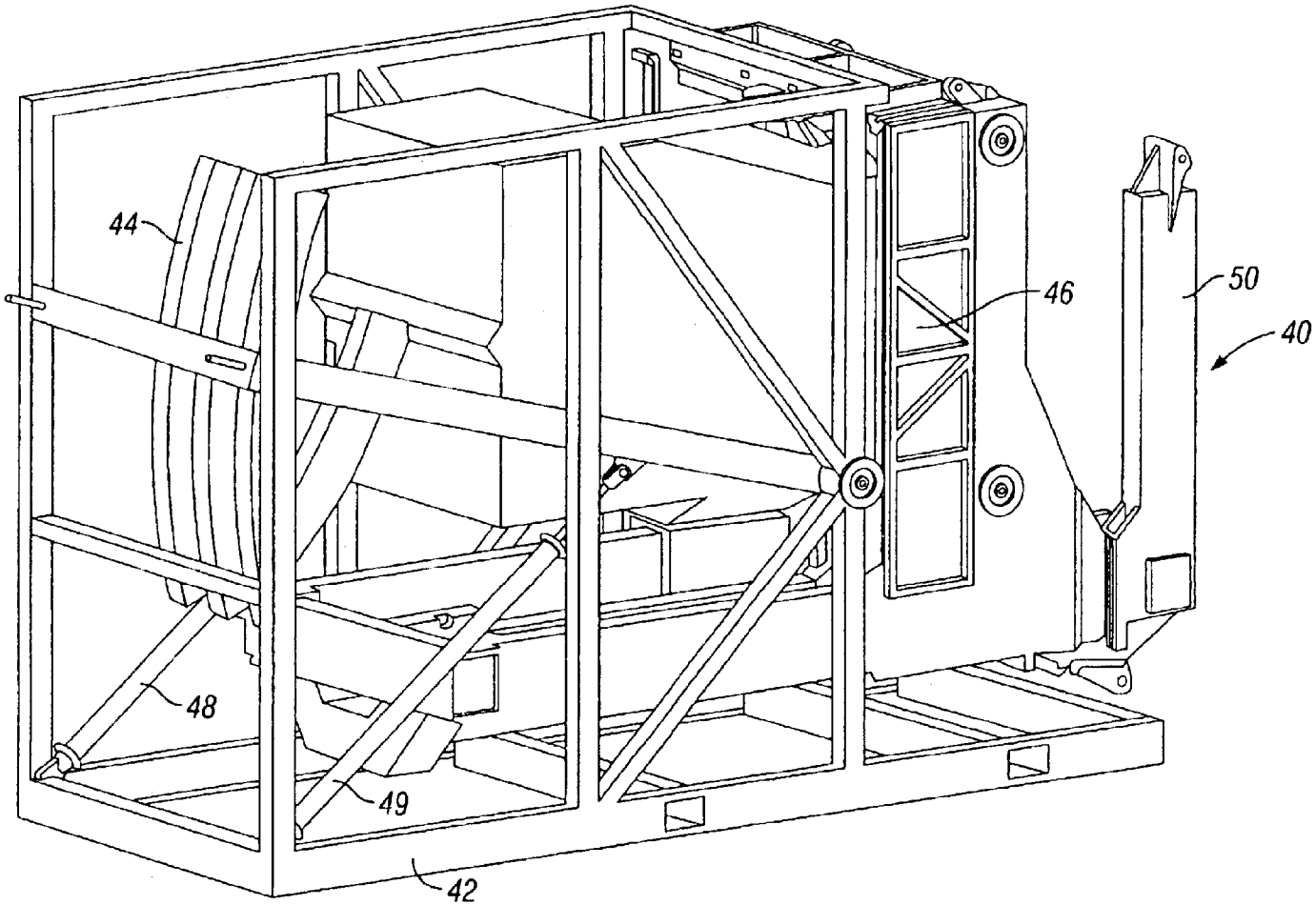
FIG. 3 is a perspective view of the jacking frame assembly in the horizontal, transport position, in accordance with the teaching of the subject invention.
Figure 4:
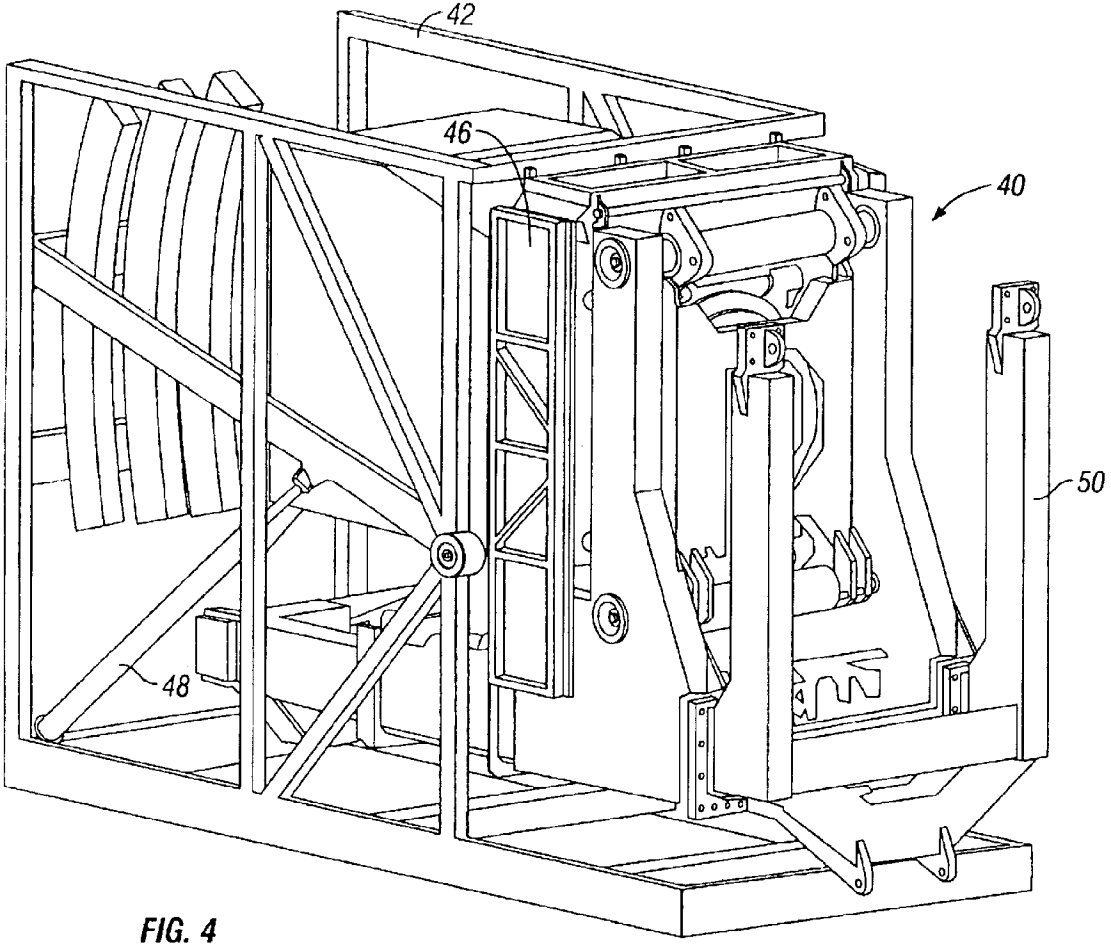
FIG. 4 is a reverse perspective view of the jacking frame assembly of FIG. 3.
Figure 5:
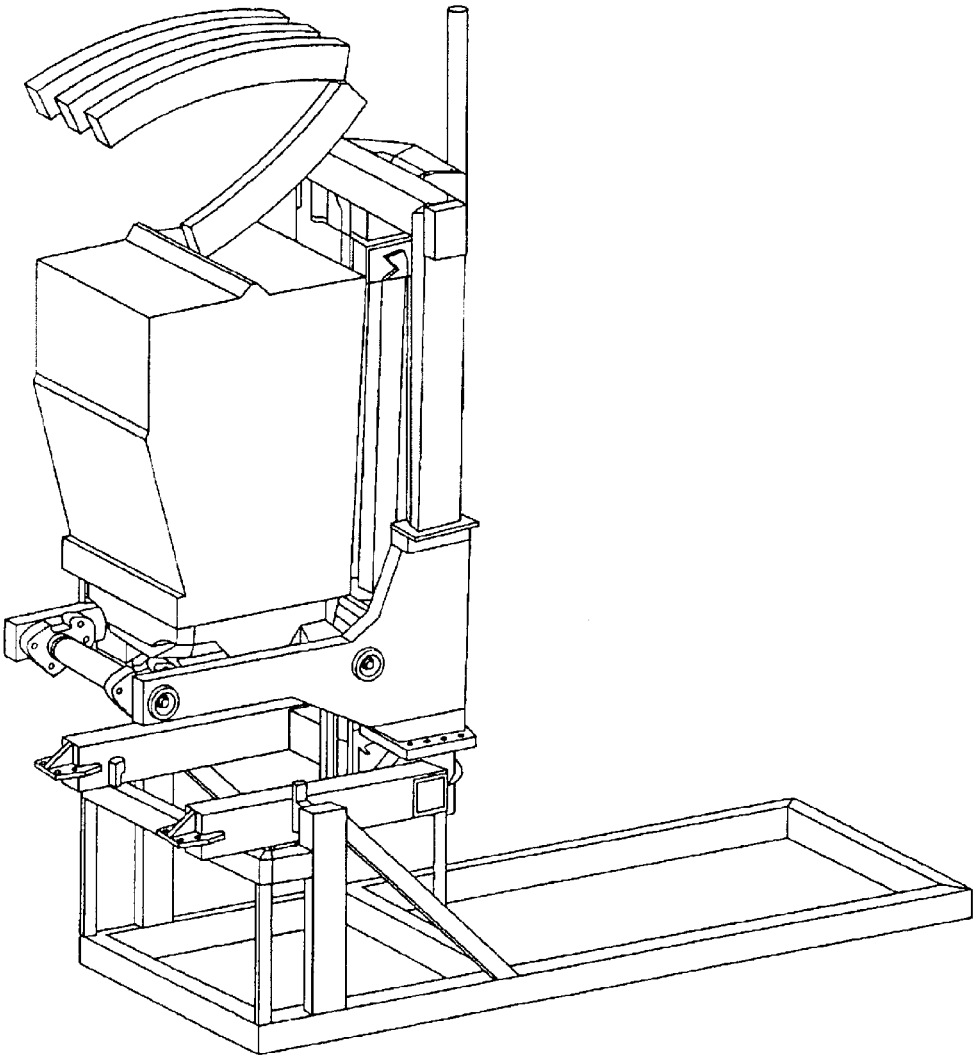
FIG. 5 is a left and right view of the jacking frame of FIGS. 3 and 4, in the vertical, operational position.

In the preferred embodiments, the additional skid supported components comprise the jacking frame 40 shown in FIGS. 3, 4, and 5. As shown in FIGS. 3 and 4, the jacking frame 40 includes a support frame 42. The jacking frame 40 is nested in a support/crash frame 42 in a horizontal position, or on its side. The jacking frame includes a gooseneck 44 which is in a folded, stowed position in FIGS. 3 and 4. The work platforms 46 are also in a stowed, folded position. This permits the jacking frame to occupy an envelope suitable for standard transportation methods. In the embodiment shown in FIGS. 3, 4, and 5, the jacking frame 40 is adapted to pivot from the horizontal, transport position of FIGS. 3 and 4 to the vertical, operating position of FIG. 5. In the preferred embodiment, this is accomplished by pivoting the rig in the frame using hydraulic drivers 48, 49, mounted on the frame and supporting the jacking frame. The lower members 50 of the jacking frame are designed to interconnect to a platform on the BOP skid, as will be shown, for supporting the assembly during operation and moving the equipment into position along the long axis of the BOP skid during Rig Up. This permits the assembly to be accurately placed on a solid support surface without relying on the orientation of the rig floor for each of the various modular components. Once the jacking frame is positioned on the skid the gooseneck 44 is unfolded and aligned with a coil tubing reel, not shown. The work platform 46 is unfolded and secured and the entire assembly is ready for operation and for connection to the various other work components, including the control systems, power systems and control cabin, in typical fashion.

A diagrammatic illustration of the operation is included in FIGS. 6–21. This illustration includes an alternative embodiment of the BOP skid and an alternative embodiment of the jacking frame. The form, fit and function of this embodiment corresponds with the embodiments of FIGS. 1–5. Like functional components are identified by the same reference numerals.

Figure 6:
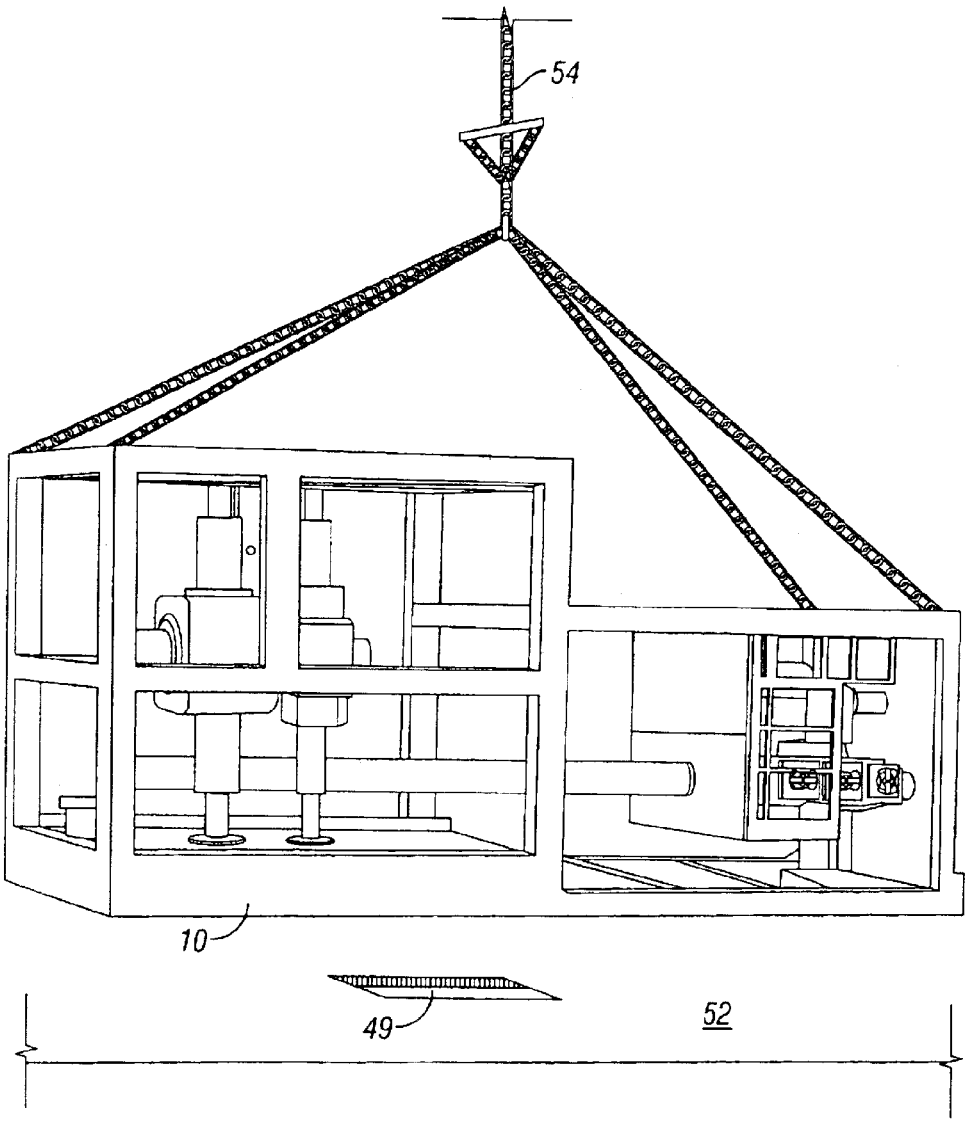
FIG. 6 is an illustration showing the BOP transport skid being lowered into position on a rig by a rig crane.
Figure 7:
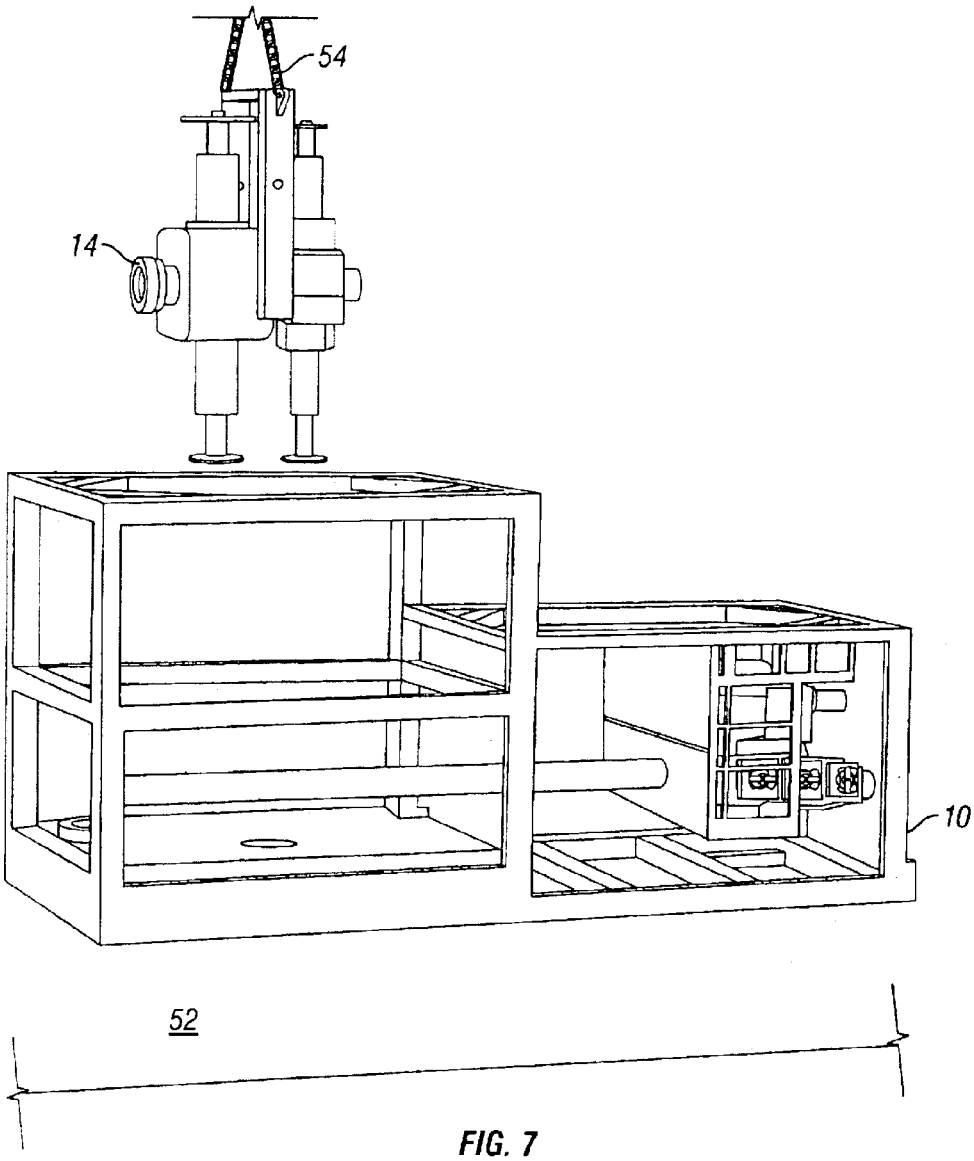
FIG. 7 is an illustration showing the safety head assembly being lifted from the skid of FIG. 6 for lowering into position through a drop floor plate.
Figure 8:
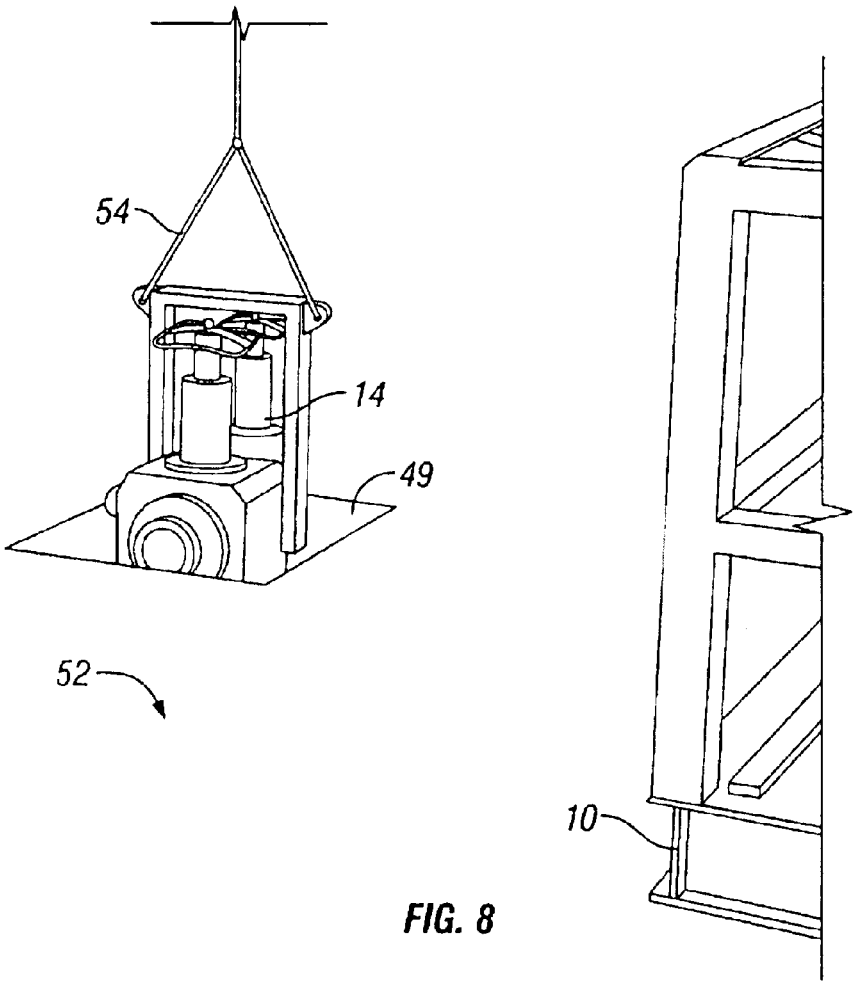
FIG. 8 is an illustration showing the safety head assembly being lowered through the floor of the rig.
Figure 9:
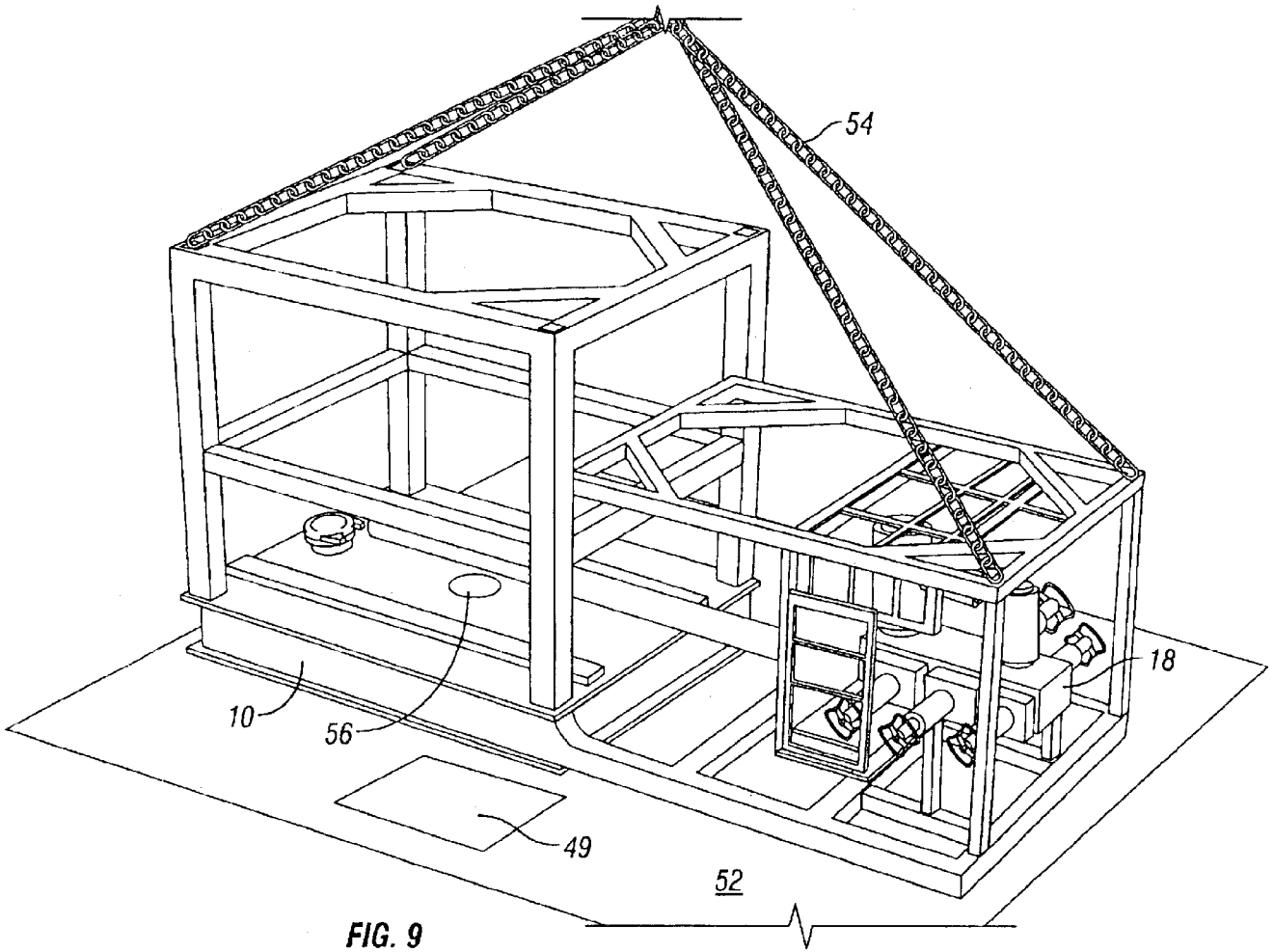
FIG. 9 is an illustration showing the positioning of the BOP transport skid over the drop plate and safety head.
Figure 10:
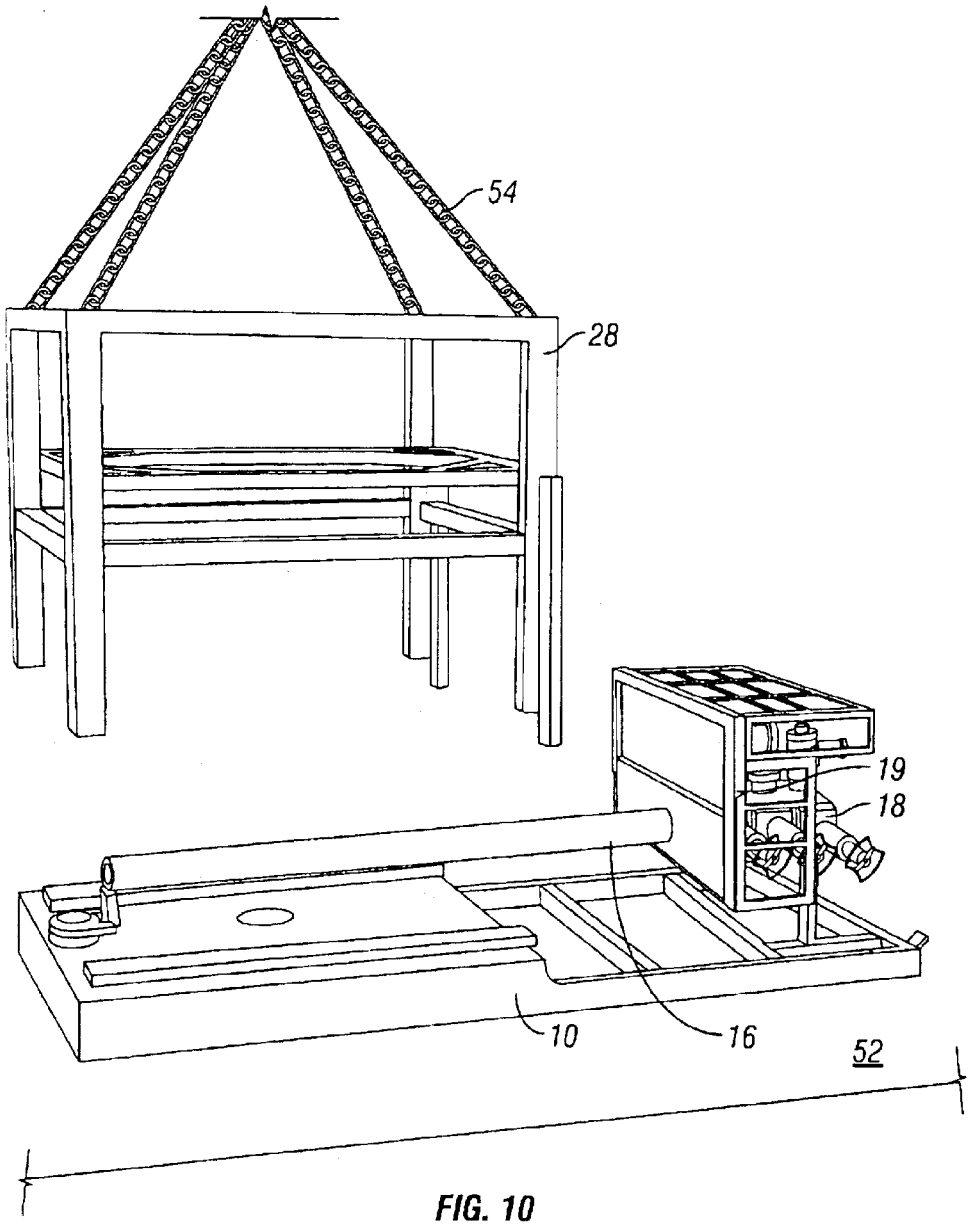
FIG. 10 is an illustration showing removal of the crash frame from the BOP transport skid.
Figure 11:
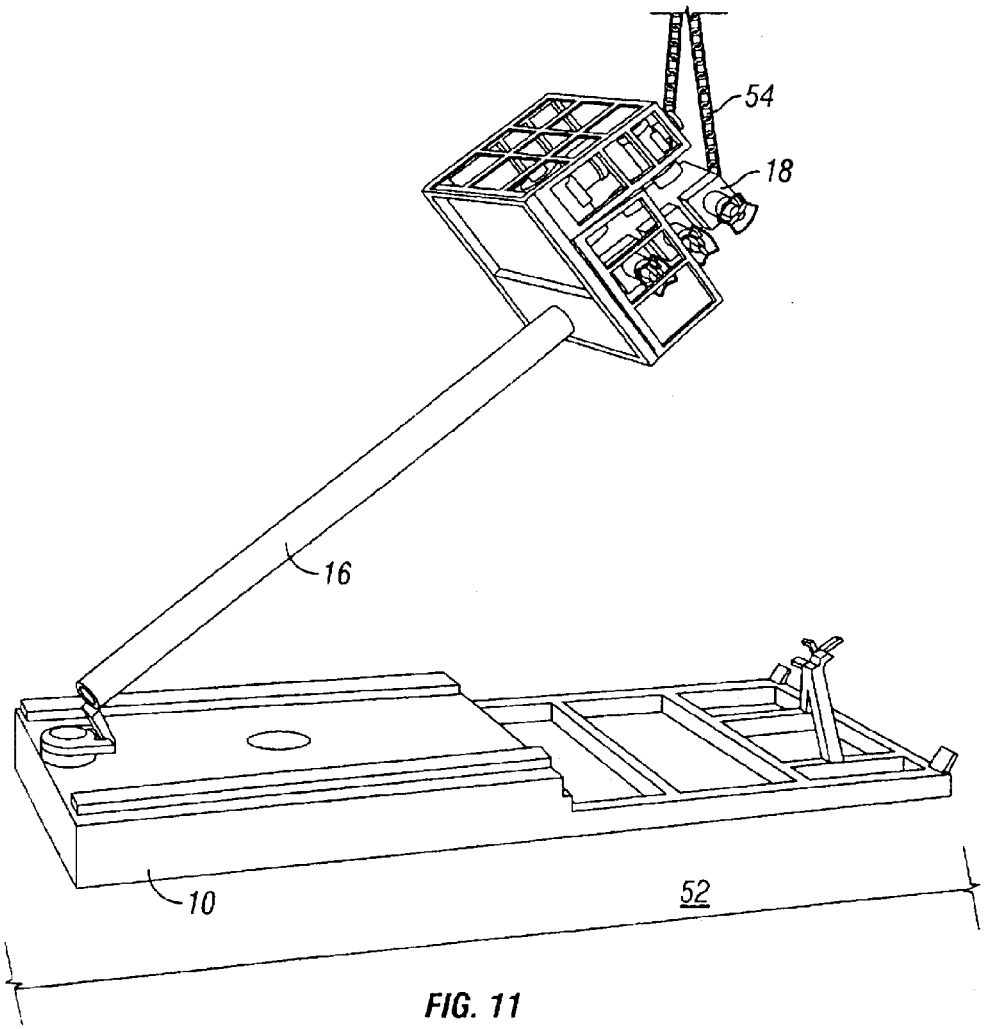
FIG. 11 is an illustration showing rotation, unpinning and installation of the BOP and riser.
Figure 12:
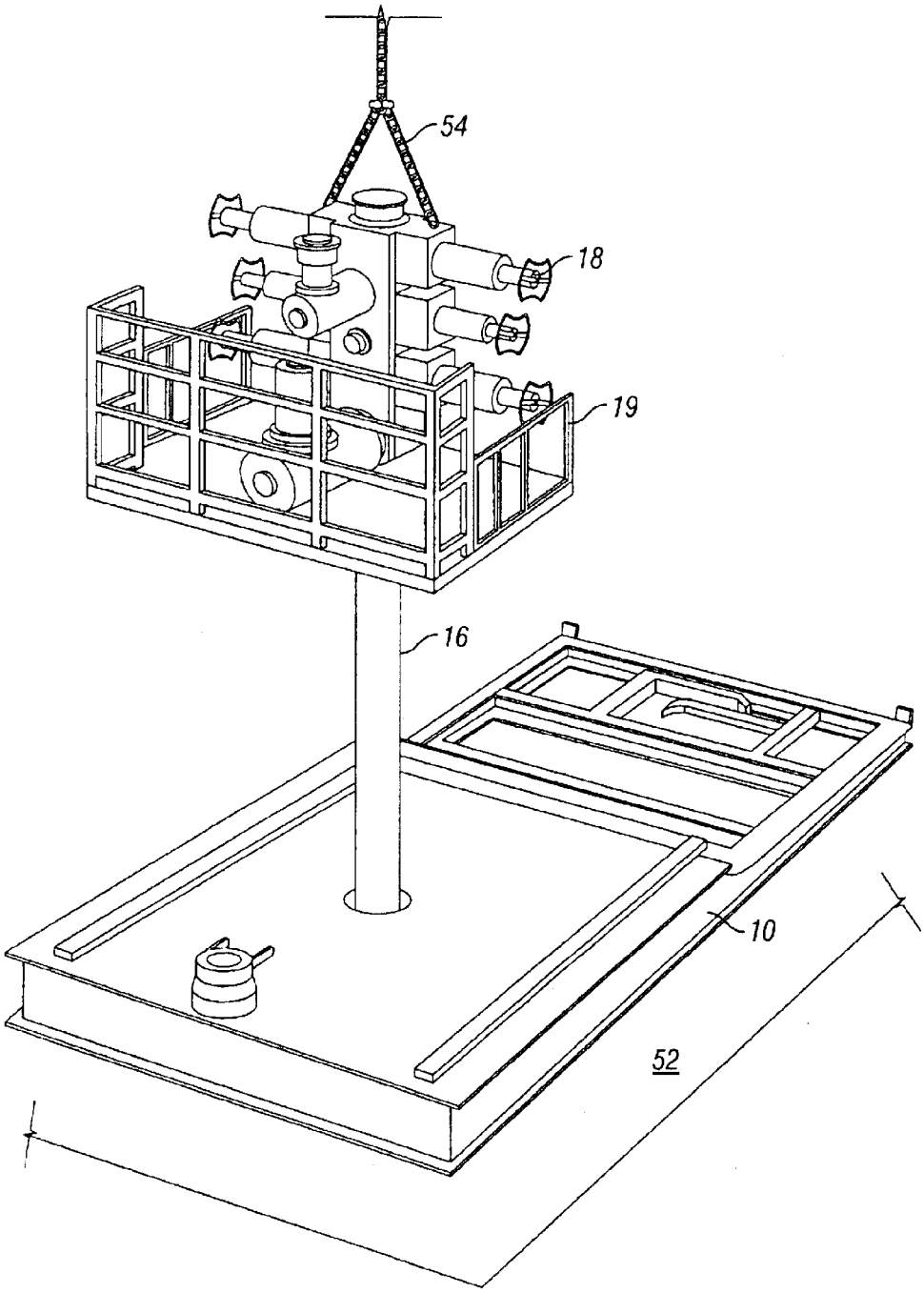
FIG. 12 is an illustration showing the BOP and riser in its install position prior to removal of the rig crane.
Figure 13:
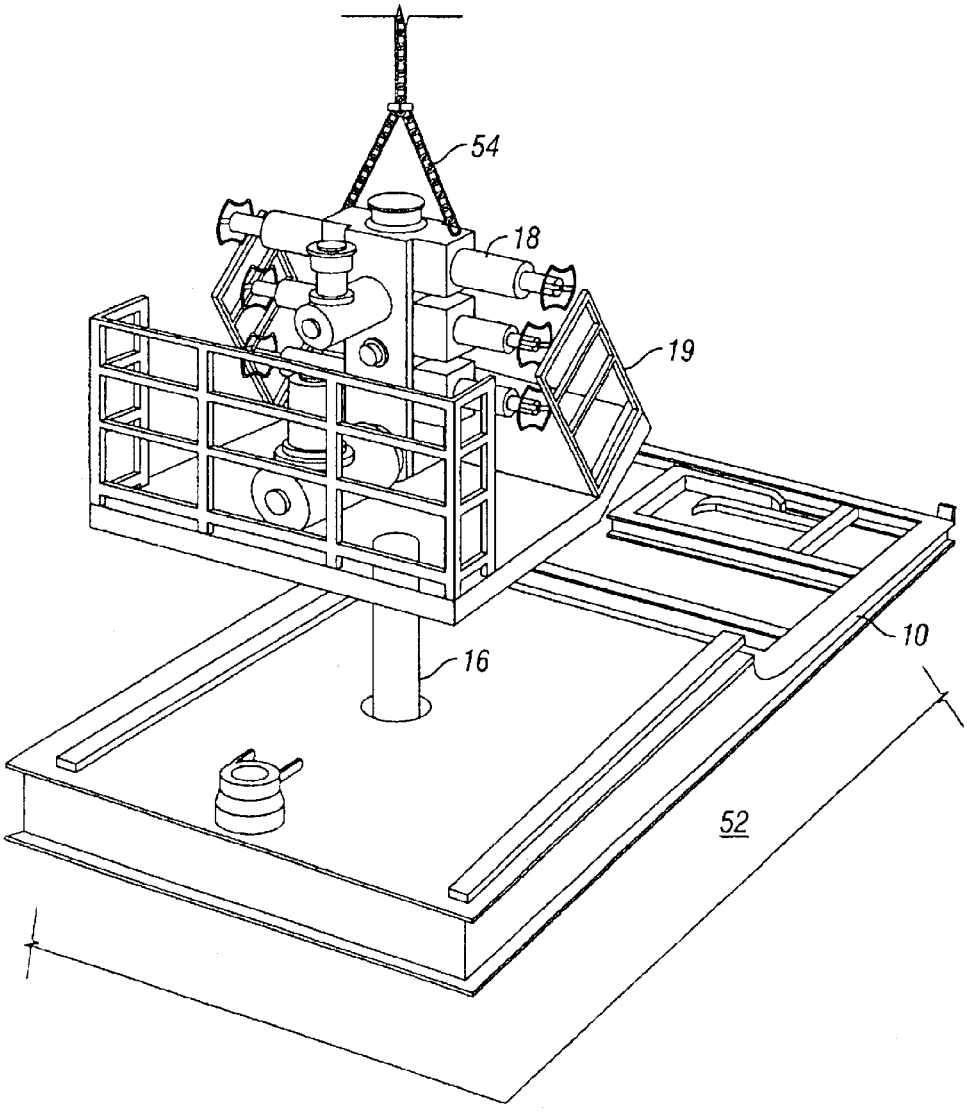
FIG. 13 is an illustration showing the deployment of the integral work platform on the BOP and riser skid system.

As shown in FIG. 6, the BOP skid 10 is positioned near the wellhead drop plate 50 on the rig floor 52 by use of the rig crane 54. The safety head 14 is then uncoupled from the skid and lifted by the crane 54, see FIG. 7. The safety head 14 is moved to position over the drop floor and lowered onto the wellhead (not shown) below the rig deck 52, see FIG. 8. The skid 10 is then picked up by the crane 54, as shown in FIG. 9, and positioned over the wellhead. Once in position, as shown in FIG. 10, the crash frame 28 is removed, leaving the skid support base and the assembled riser 16 and BOP stack 18. In this configuration, the assembly includes a stowed work platform 19. Once positioned, the riser/BOP assembly 16, 18 is pivoted into position over the wellhead and lowered onto the safety head as shown in FIGS. 11 and 12. The work platform is then unfolded and secured, as shown in FIG. 13 and the assembly of the safety head/riser/BOP stack is completed.

Figure 14:
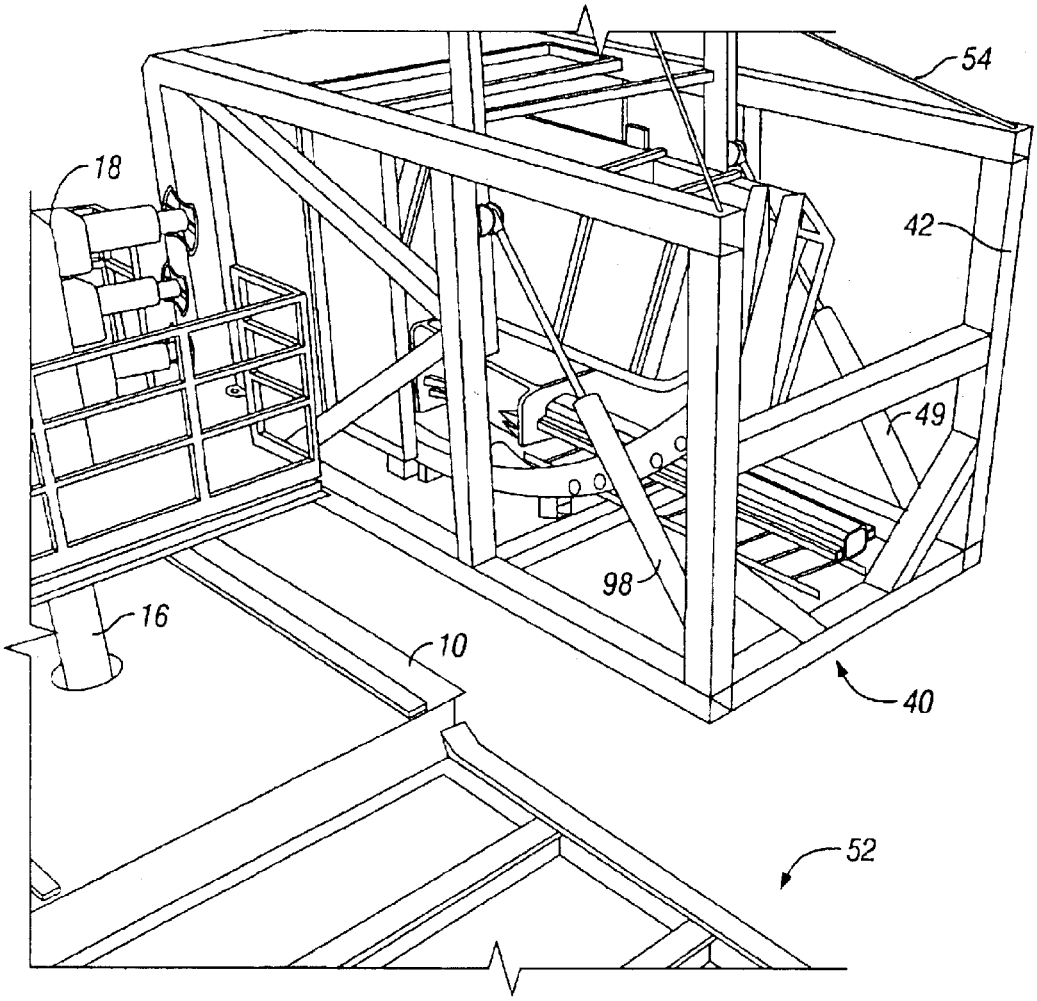
FIG. 14 is an illustration showing the positioning of the jacking frame using the rig crane, with the jacking frame assembly in the horizontal, transport position.
Figure 15:
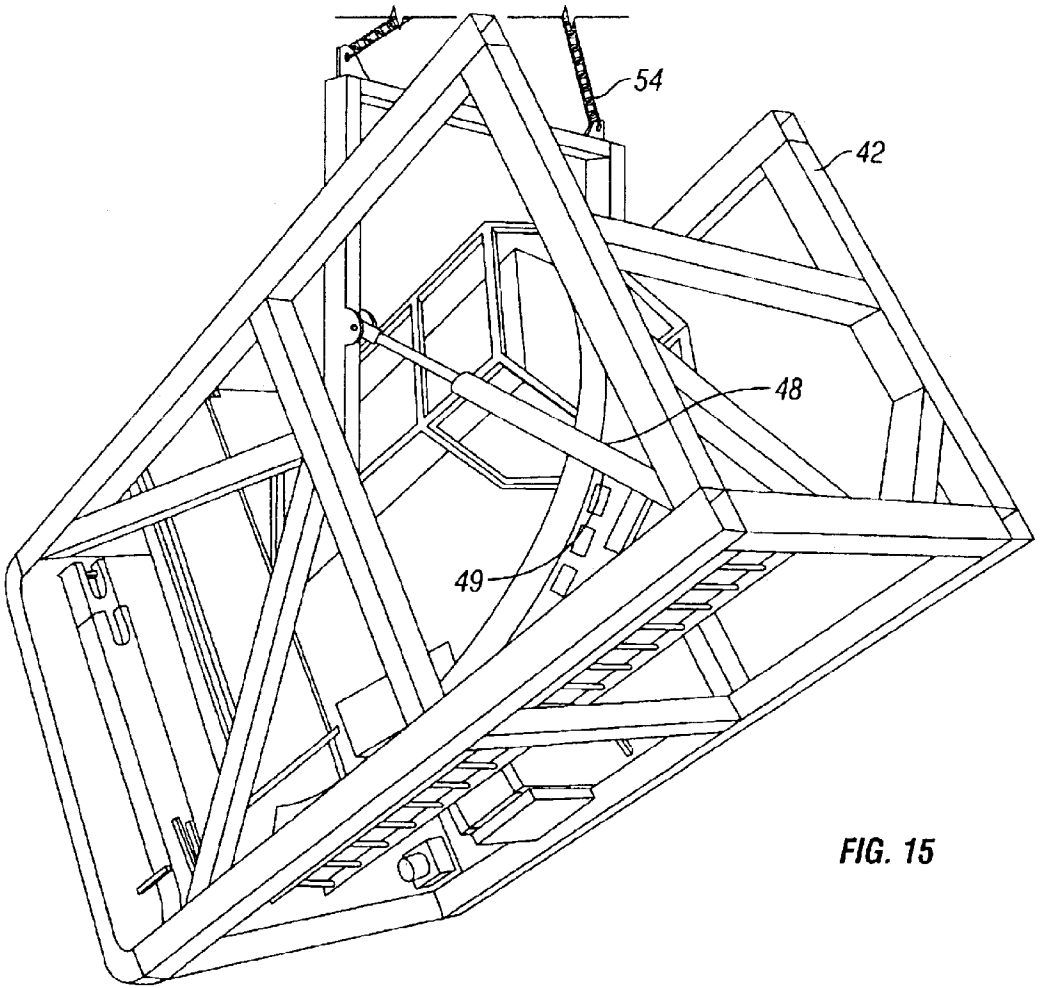
FIG. 15 is an illustration showing the rotation of the jacking frame to the vertical, operating position.
Figure 16:
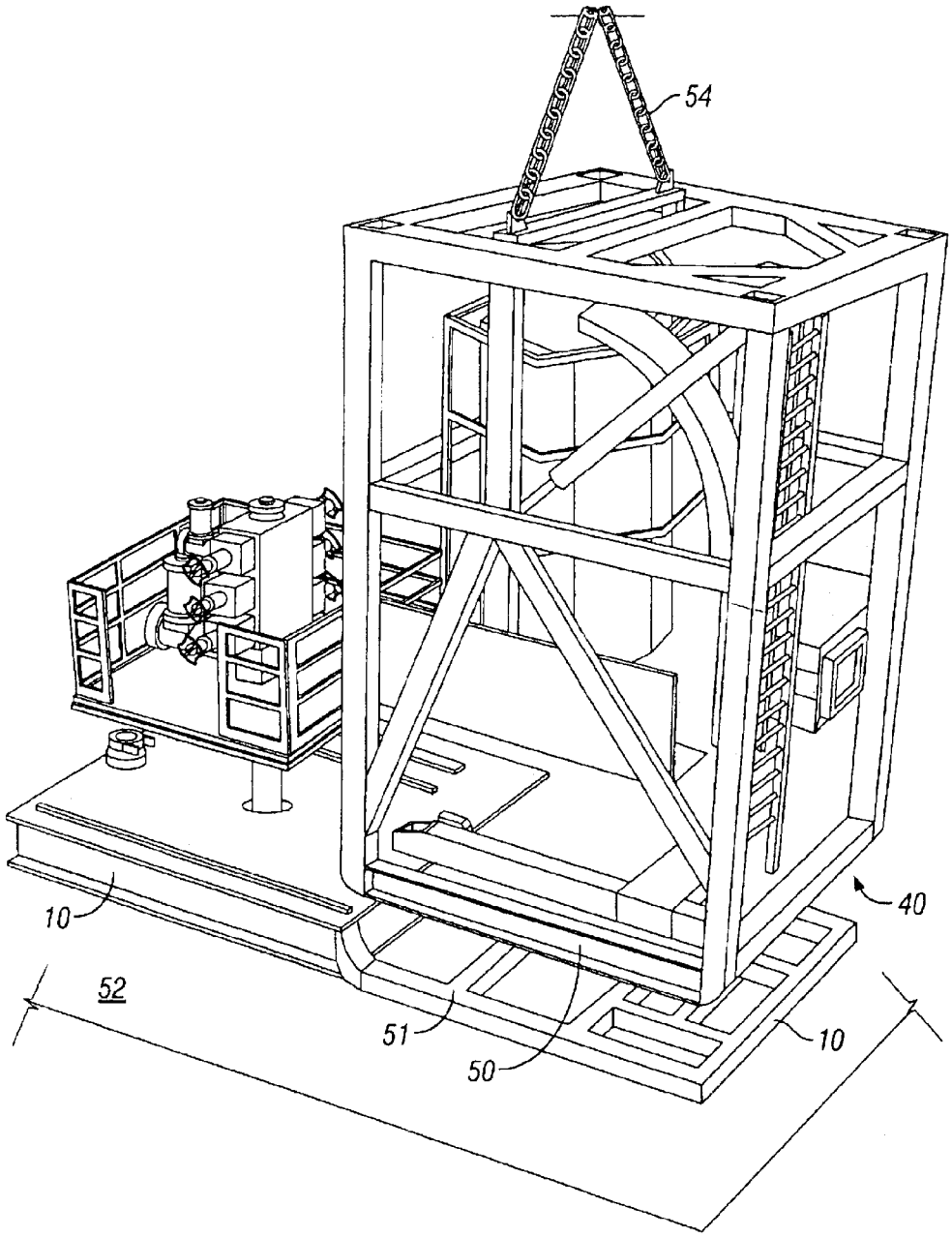
FIG. 16 is an illustration showing placement of the jacking frame in the BOP transport skid using the rig crane.
Figure 17:
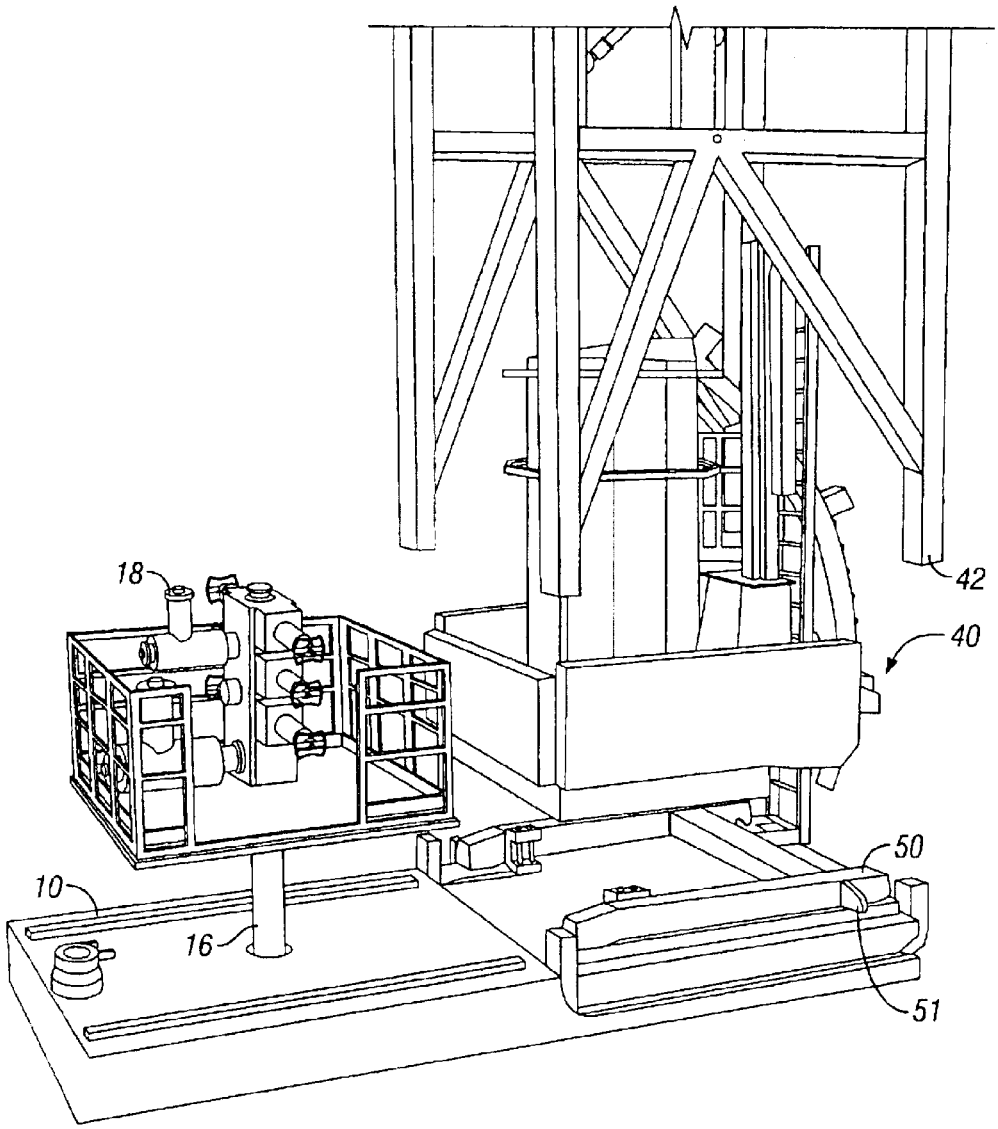
FIG. 17 is an illustration showing removal of the jacking frame crash frame.
Figure 18:
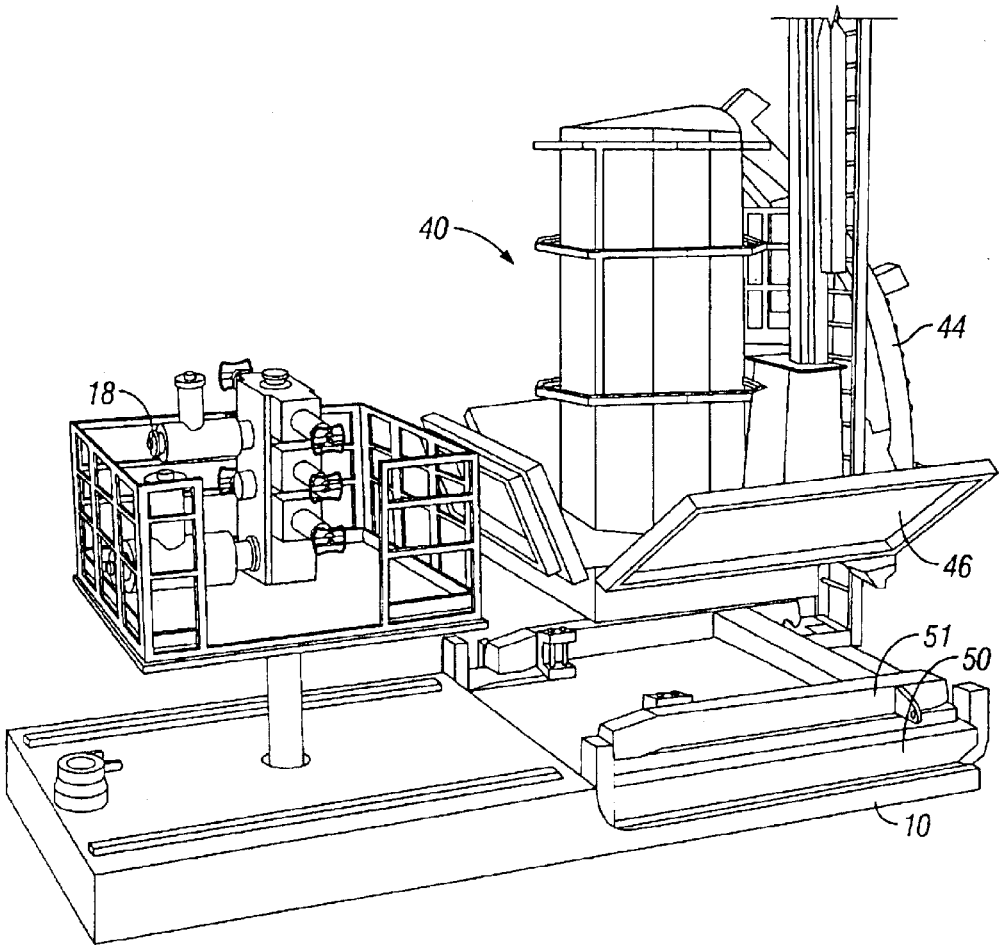
FIG. 18 is an illustration showing the deployment of the integral work platform on the jacking frame.
Figure 19:
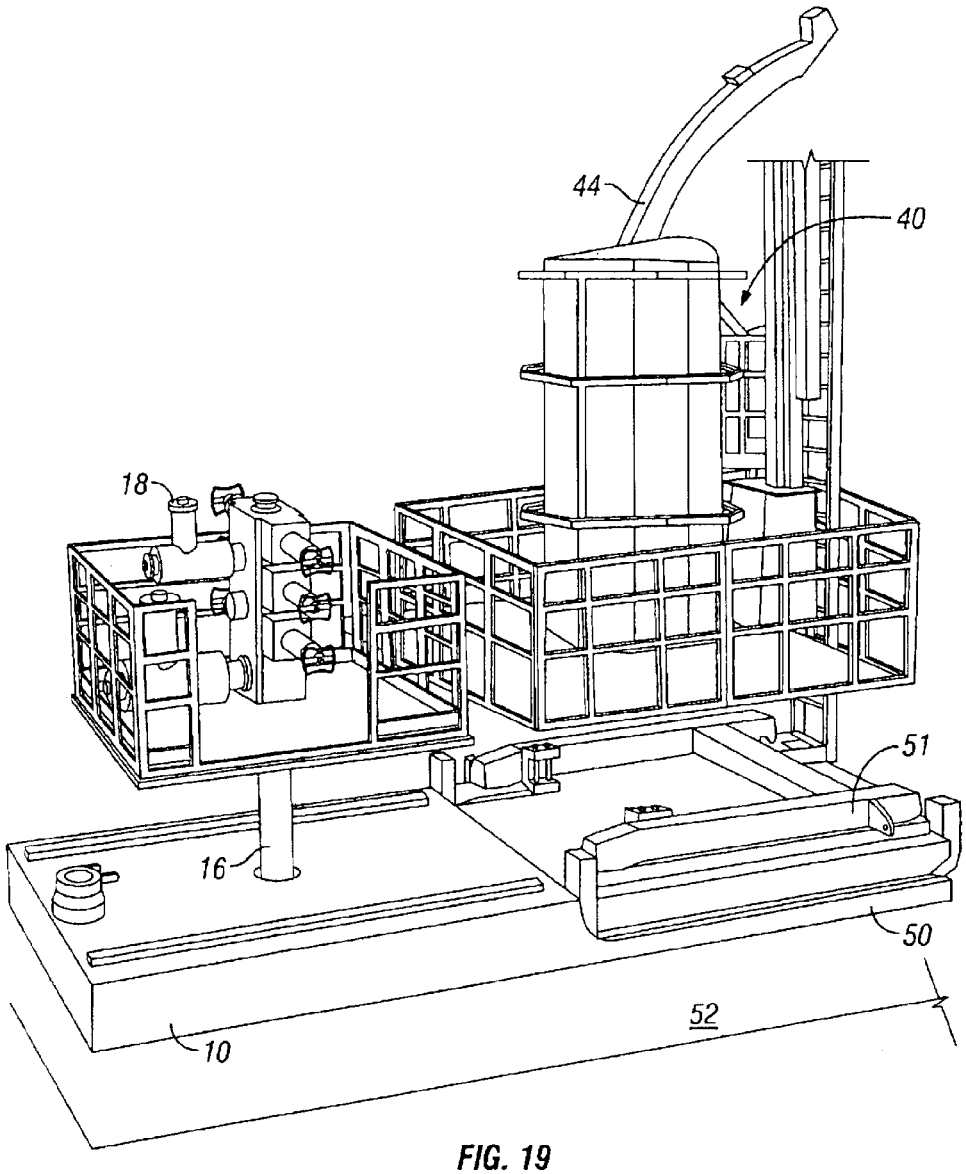
FIG. 19 is an illustration showing unfolding and raising of the gooseneck and alignment of the gooseneck with the reel (not shown).
Figure 20:
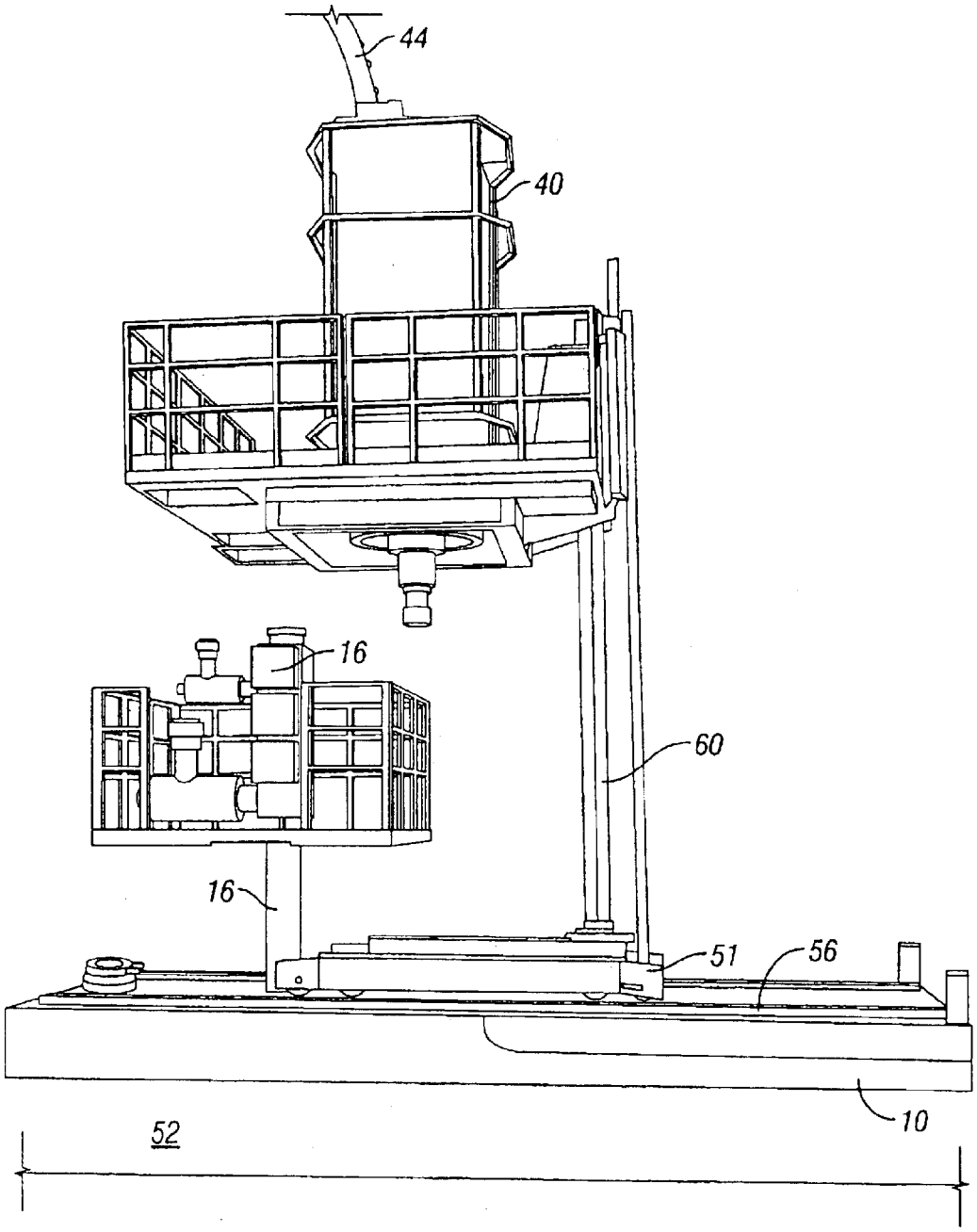
FIG. 20 is an illustration showing the vertical translation of the jacking frame on its column and horizontal translation of the jacking frame on the BOP skid rails to position the jacking frame in operating position on the stack and riser.
Figure 21:
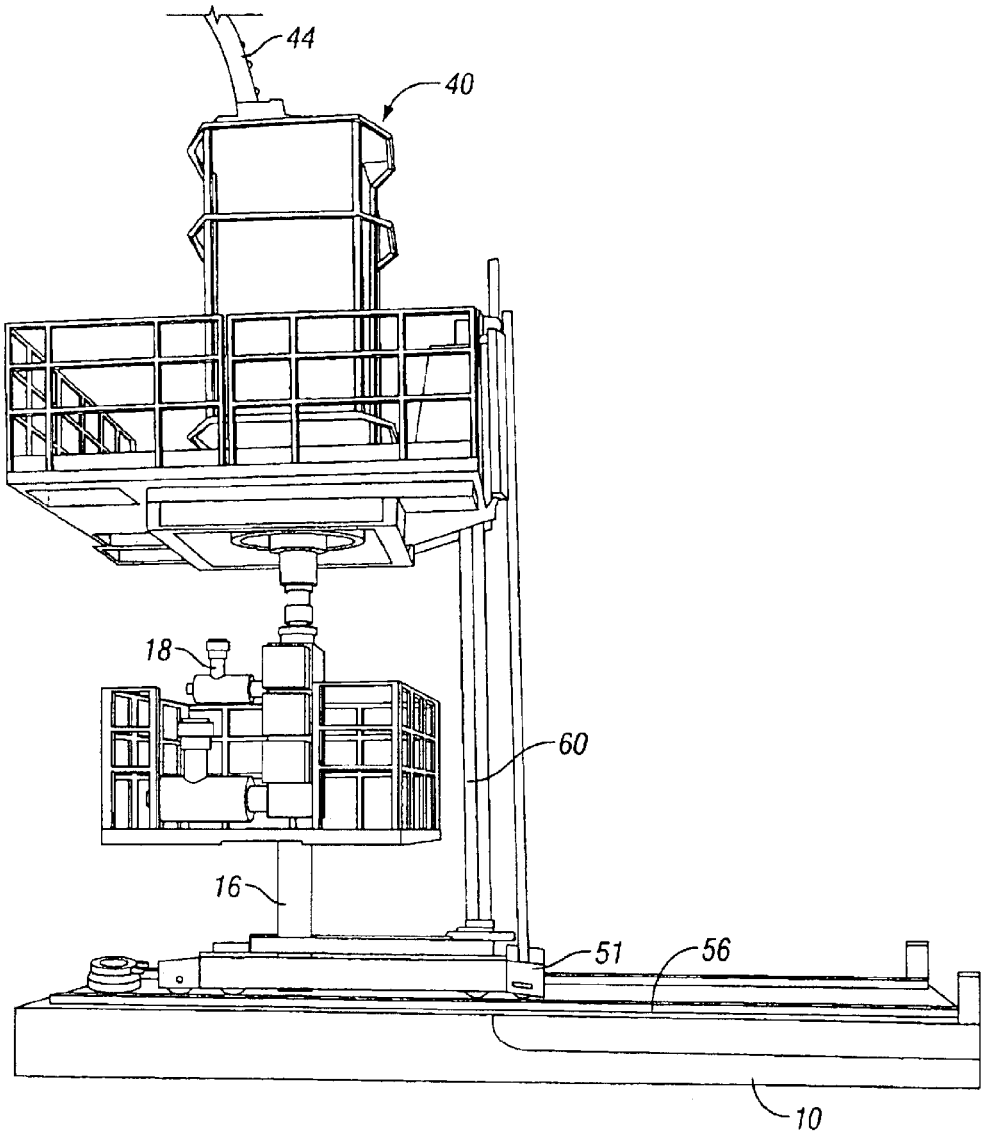
FIG. 21 shows the BOP stack, riser and jacking frame in operating assembly.

Once the riser system is in place, the operation is ready for installation of the jacking frame 40. The jacking frame 40 is positioned near the assembled BOP skid unit 10 by the crane 54, as shown in FIG. 14. The crash frame 42 is removed, see FIG. 17. The hydraulic rams 48, 49 then rotate the jacking crane to its vertical, operating position, as shown in FIG. 15. The support rails 50 are then positioned on the trolley rails 51 on the skid, see FIG. 16. The work platform 46 is unfolded and assembled as shown in FIG. 18. The gooseneck 44 is unfolded and the injector is aligned with the reel (not shown), see FIG. 19. Then, as shown in FIG. 20, the jacking frame 20 is horizontally moved along rails 51 to operating position over the well head and lowered on support column into position on the BOP stack, as shown in FIG. 21. The entire assembly may now be completed and readied for operation.

This modular approach permits the sub-assemblies to be factory assembled and tested. In the preferred embodiment this would include the safety head assembly, the riser/BOP assembly and the jacking frame. These sub-assemblies may then be transported and assembled as units on the rig floor, greatly reducing Rig Up time while at the same time increasing safety and reducing the amount of manpower required on the rig to complete the operation. While the system is shown in connection with a jacking frame, it is readily adaptable to other rig workover operations.

While certain features and embodiments of the invention have been shown in detail herein, it should be recognized that the invention includes all modifications and enhancements within the scope of the accompanying claims.

What is claimed is:

1. A modular assembly for transporting and deploying multiple pre-assembled subassemblies for coiled tubing operating systems for a rig, the modular assembly comprising:

a. a first skid assembly for housing subassemblies, the first skid including a lower support surface for supporting the skid on the rig and an upper support surface for supporting additional components;

b. subassemblies mounted on the first skid;

c. a second skid assembly including a support surface adapted to be mounted on the upper support surface of the first skid for securing and positioning a work specific assembly on the first skid; and wherein the subassemblies housed in the first skid include:

d. a lower wellhead assembly;

e. a riser;

f. an assembled BOP stack.

2. The modular assembly of claim 1, wherein the lower wellhead assembly includes at least one shear ram.

3. The modular assembly of claim 1, wherein the lower wellhead assembly includes a safety head.

4. The modular assembly of claim 1, wherein the lower wellhead assembly, the riser and the assembled BOP stack components are positioned on the first skid such that the first skid and components occupy an envelope suitable for transport by standard transport means.

5. The modular assembly of claim 1, further including a removable crash frame on the first skid for protecting the subassemblies mounted thereon.

6. The modular assembly of claim 1, wherein the work specific assembly is a jacking frame which permits horizontal movement relative to a wellbore.

7. The modular assembly of claim 6, wherein said jacking frame is a single column-type design.

8. The modular assembly of claim 6, further including a support frame for supporting the jacking frame in a rotated position whereby the jacking frame occupies an envelope suitable for transport by standard support means.

9. The modular assembly of claim 8, wherein the support frame is a removable crash frame.

10. The modular assembly of claim 6, further including means for rotating the jacking frame from the rotated position to an operating position while in the support frame.

11. The modular assembly of claim 6, further including a stowable work platform on the jacking frame.

12. The modular assembly of claim 1, further including a stowable work platform on the riser/BOP assembly.

13. A method for setting up and assembling a work operation on a rig floor comprising the steps of:

f. Positioning a skid mounted lower wellhead assembly and riser/BOP assembly on a rig floor near the wellhead;

g. Removing the lower wellhead assembly from the skid and lowering it onto the wellhead;

h. Positioning the skid over the wellhead;

i. Positioning the riser/BOP on the lower wellhead assembly through the skid and the rig floor;

j. Positioning a work specific assembly on the skid and in position on the riser/BOP and mounting the work specific assembly to the skid.

14. The method of claim 13, wherein the lower wellhead assembly comprises a shear ram.

15. The method of claim 13, wherein the lower wellhead assembly comprises a safety head.

16. The method of claim 13, wherein the work specific assembly comprises a jacking frame.

17. The method of claim 16, wherein the jacking frame is mounted in a support frame in a rotated position and wherein the method includes rotating the jacking frame to a work position while in the frame and before positioning the jacking frame on the skid.

18. A modular assembly for transporting and deploying multiple pre-assembled subassemblies for coiled tubing operating systems for a rig, the modular assembly comprising:

a. a first skid assembly for housing subassemblies, the first skid including a lower support surface for supporting the skid on the rig and an upper support surface for supporting additional components;

b. subassemblies mounted on the first skid;

c. a second skid assembly including a support surface adapted to be mounted on the upper support surface of the first skid for securing and positioning a work specific assembly on the first skid; and wherein the subassemblies housed in the first skid include:

a well control stack, said well control stack including an upper BOP connected to a riser.

19. The modular assembly of claim 18, further including a lower BOP.

20. The modular assembly of claim 19, further including an additional riser.

* * * * *